US009890551B1

(12) United States Patent
Delao et al.

(10) Patent No.: US 9,890,551 B1
(45) Date of Patent: Feb. 13, 2018

(54) PORTABLE UMBRELLA STAND AND METHOD OF USE

(71) Applicants: Joseph Delao, Pearland, TX (US); Mark Mitchell, Baytown, TX (US)

(72) Inventors: Joseph Delao, Pearland, TX (US); Mark Mitchell, Baytown, TX (US)

( * ) Notice: Subject to any disclaimer, the term of this patent is extended or adjusted under 35 U.S.C. 154(b) by 0 days.

(21) Appl. No.: 15/270,522

(22) Filed: Sep. 20, 2016

(51) Int. Cl.
*E04H 12/22* (2006.01)
*E04H 15/62* (2006.01)
*A45B 25/00* (2006.01)
*A45B 23/00* (2006.01)

(52) U.S. Cl.
CPC ..... *E04H 12/2215* (2013.01); *A45B 25/00* (2013.01); *E04H 15/62* (2013.01); *A45B 2023/0012* (2013.01); *A45B 2025/003* (2013.01); *A45B 2200/10* (2013.01)

(58) Field of Classification Search
USPC ..... 248/545, 558, 523, 530, 533, 156; 135/16
See application file for complete search history.

(56) References Cited

U.S. PATENT DOCUMENTS 2,883,247 A * 4/1959 Thompson ..... A45B 3/00 108/50.12
3,119,588 A 1/1964 Keats
4,148,455 A 4/1979 Oliver
4,240,766 A 12/1980 Smith et al.
4,753,411 A * 6/1988 Lechner ..... E04H 12/2215 248/156
4,979,490 A * 12/1990 Nudo ..... F24B 1/205 126/25 A
5,088,681 A 2/1992 Procaccianti et al.
5,273,062 A * 12/1993 Mozdzanowski ..... A45B 3/00 135/16
5,354,031 A 10/1994 Bilotti
6,032,880 A 3/2000 Verrills et al.
6,487,977 B1 * 12/2002 Williams ..... A45B 23/00 108/150
6,612,320 B2 * 9/2003 Lin ..... A45B 25/22 135/33.41
6,675,819 B2 * 1/2004 Arrowood ..... A45F 3/44 135/118
6,732,985 B1 * 5/2004 Cantrell ..... A45F 3/44 248/125.1
6,908,067 B2 6/2005 Clasen
6,953,180 B1 10/2005 Ruvalcaba et al.
7,175,141 B2 * 2/2007 Bolinder ..... E04H 12/2215 248/156
7,207,450 B1 4/2007 Franklin et al.
7,264,210 B2 9/2007 Yu
7,264,218 B1 9/2007 Edwards
7,380,561 B2 6/2008 Nobert et al.
7,520,485 B1 4/2009 Giannetto
(Continued)

FOREIGN PATENT DOCUMENTS

EP 0365572 2/1987
EP 1 693 535 A2 8/2006

*Primary Examiner* — Bradley Duckworth
(74) *Attorney, Agent, or Firm* — Ewing & Jones, PLLC

(57) ABSTRACT

A tubular holder with a circular base, a central column, spokes attached to the central columns and ground spikes attached to spokes or bottom of the circular base. In some variations the spokes have orifices for engaging a cup with a cup spike.

14 Claims, 6 Drawing Sheets

(56) References Cited

U.S. PATENT DOCUMENTS

| | | | | |
|---|---|---|---|---|
| 7,614,600 | B1 * | 11/2009 | Smith | E04H 12/2246 135/16 |
| 7,980,520 | B2 * | 7/2011 | Taylor | A45F 3/44 248/156 |
| 8,082,934 | B1 * | 12/2011 | Kucinski | E04H 12/2238 135/118 |
| 8,371,319 | B2 * | 2/2013 | Meibos | A45B 23/00 108/50.12 |
| D721,481 | S * | 1/2015 | Elazar | D3/10 |
| 8,978,676 | B2 * | 3/2015 | Williams | E04H 12/2238 135/16 |
| 2005/0189005 | A1 | 9/2005 | Smith et al. | |
| 2006/0016950 | A1 | 1/2006 | Bright et al. | |
| 2006/0054206 | A1 | 3/2006 | Bilotti | |
| 2008/0017226 | A1 | 1/2008 | Norbet et al. | |
| 2009/0039230 | A1 * | 2/2009 | Cheng | A47G 33/12 248/523 |
| 2009/0090836 | A1 * | 4/2009 | Harris | E04H 12/2238 248/530 |
| 2010/0000164 | A1 * | 1/2010 | Russell | E04H 12/2215 52/165 |
| 2010/0200724 | A1 | 8/2010 | Kukuk | |
| 2011/0303806 | A1 * | 12/2011 | Samaras | A01M 31/06 248/156 |
| 2015/0060631 | A1 | 3/2015 | Pan | |

* cited by examiner

PORTABLE UMBRELLA STAND AND METHOD OF USE

CROSS-REFERENCE TO RELATED APPLICATIONS

Not applicable

STATEMENT REGARDING FEDERALLY SPONSORED RESEARCH

Not applicable.

BACKGROUND

The present invention relates to an improved umbrella or tubular stand and method of use with, in many embodiments, spikes on the outer radius of a support wheel with an umbrella stand coupling in the middle.

The present invention is distinguished from the following art in many ways.

US Patent US 2010/0200724 ("'724") is primarily designed as an umbrella holder anchor. The present invention solves the problem of '724 by being able to function in various ground conditions, hold multiple size umbrellas, or tubulars and withstand heavy weather conditions such as strong wind and rain. The circular shape of the base of the present invention with multiple spikes creates a more stable umbrella holder than that as disclosed in '724. The present invention is also different than '724 because the umbrella base is made of steel, has six spikes that are round to create an equal distribution of force from every direction. With the equal force distribution, the present invention can be used in sand, dirt, mud and grass and still have the stability to withstand heavy wind and weather. In several embodiments, the present invention is able to hold multiple size umbrellas or tubulars and can be moved from location to location.

US Patent 2015/0060631 ("'631") is for a pole securement and an umbrella base assembly including the same. The present invention solves the problem of ("'631") by being able to be utilized on uneven ground and be moved with very little difficulty. The present invention is also different than ("'631") because the present invention is made for use on dirt, sand, mud, and grass, on level ground or uneven surface, like a slope of a driveway or a hill. In several embodiments, the present invention is made of steel, has six spikes and has a base that is circular in shape. With the base of the inventive umbrella holder being round, all points of the umbrella holder have equal force disbursement from its center. No one side receives pressure from wind or weather at a different level than the other. Stability is the main focus when inserting the present invention into the ground.

U.S. Pat. No. 6,032,880 ("'880") is a ground spike for sun umbrella. The present invention solves the problem of '880 by being able to be used on multiple surfaces, as well as the beach. The present invention is also different than '880 because instead of one single spiral spike, the present invention has six spikes, and a circular base that does not need to be screwed into the sand, dirt, mud or grass. The present invention is preferably made of steel, and round in diameter which allows the umbrella holder to hold various size umbrellas and to be more stable against high winds. The present invention will be able to be used on uneven surfaces and be moved with ease.

U.S. Pat. No. 7,520,485 ("'485) is a patent for a multi-mode beach umbrella anchor. The present invention solves the problem of '485 by having multiple spikes that are inserted into the ground which cause a greater stability factor when using it at the beach or other locations. The present invention is also different than '485 because the present invention has six individual spikes made from steel which can be pushed into multiple surfaces in level or unlevel areas. The base is round and made of steel as is the tube that holds the umbrella. The present invention can be moved with very little effort by pulling on the top part of the tube. The present invention does not require a hammer or excessive force to insert into the ground.

U.S. Pat. No. 6,908,067 ("'067") is a ground anchoring sunshade umbrella stand. The present invention solves the problem of '067 by providing a solid foundation for a removable umbrella holder which can hold multiple size umbrellas and still keep the integrity of the base. The present invention is also different than '067 because the base of the present invention, in many embodiments, is more robust and made of steel with a round base, as well as having multiple spikes so it can be used in mud, grass, dirt and sand. The present invention can also be used on uneven ground while stably holding a large umbrella. The present invention can carry different size umbrella from 6 ft. to 12 ft.

U.S. Pat. No. 6,953,180 ("'180") discloses an invention for anchoring device for an umbrella. The present invention solves the problem of '180 by providing a moveable stand that is sturdy enough to hold various umbrellas from all different sizes and still withstand the elements of the weather. The present invention is also different than '180 because the present invention has a round base, made of steel and has six solid steel spikes which will create a more stable stand for the umbrella. Not only are there six spikes, the tube of the present invention is able to hold various size umbrellas. The present invention also can be set up and taken down with very little effort and be used in different elements, i.e. grass, sand, dirt, and mud. The present invention will also function on uneven ground, on a hill, and very soft ground.

U.S. Pat. No. 4,240,766 ("'766") is an invention for a traffic delineator. The present invention solves the problem of '766 by being able to function in soft surfaces and create shade for the individual. The present invention is also different than '766 because the present invention does not function on concrete and does not have a singular pipe that goes into the ground. The present invention is round in diameter, has six spikes, and is made to carry an umbrella on multiple surfaces in hard or soft surfaces. The present invention is made of steel. The present invention also can hold many different size umbrellas and still have the stability to function without failing over.

U.S. Pat. No. 5,088,681 ("'681") discloses an anchor device. The present invention solves the problem of US Patent '681 by being to function in various ground surfaces and be moved with very little trouble. The present invention does not need to be screwed into the ground to be made to work. The present invention is also different than US Patent '68 because it is solid steel, the base is round to help with stability, and it has six spikes and can function in multiple ground conditions. The present invention is also able to hold various size umbrellas and will not compromise its stability. The present invention is designed to work and function with very little effort. It will be able to move from one location to another. Light weight and easy to use.

US Patent 2006/0016950 ("'950") is for a beach umbrella base. The present invention solves the problem of '950 by working on other surfaces other than the beach. The present invention is also different than '950 because it does not limit the use of the holder to only be used at the beach. The present invention does not require adding dirt, sand or other loose material to create the stability of the holder. The present invention is designed to function in and on multiple ground surfaces, hold multiple size umbrellas and have the strength to with stand weather condition. The present invention is made of steel, round in diameter, with six spikes that will give the owner a solid umbrella holder.

U.S. Pat. No. 7,264,210 ("'210") discloses a portable umbrella stand. The present invention solves the problem of '210 by being more stable and stronger than a single tube that is inserted into the ground. The present invention is also different than '210 because the base is not one single tube that holds an umbrella. The present invention is made of steel, is round to help with stability and has six spikes. The present invention can be used in multiple surfaces, soft or hard and will not topple over in heavy winds. The present invention is able to hold many size umbrellas, can be used in dirt, sand, mud, or grass.

U.S. Pat. No. 4,148,455 ("'455") discloses a stand for tubular articles. The present invention solves the problem of '455 by giving the user a way to create shade by being an umbrella holder. The present invention can hold multiple size umbrellas. The present invention requires no filling of water, sand, dirt or any other material to function properly. The present invention is also different than '455 because it was designed to hold umbrellas of various sizes. The present invention does require to be used on flat surfaces, can and will function in mud, dirt, sand, grass and gravel. The present invention is made of steel, round in diameter, has six spikes that go into the ground; this invention can withstand the elements like rain and or heavy winds without falling over.

U.S. Pat. No. 3,119,588 ("'588") discloses a portable sign. The present invention solves the problem of '588 by not being a portable sign holder. The present invention is also different than US '588 because it was designed and made to hold multiple size umbrellas on various ground surfaces. The present inventions was to function solely as item that creates shade for the individual.

U.S. Pat. No. 7,264,218 ("'218") discloses a portable/collapsible sunshade umbrella stand assembly. The present invention solves the problem of '218 by being able to function on uneven ground surfaces and utilize the spikes to create a stable shade for the user. The present invention is also different than '218 because the present invention is light weight, yet sturdy enough to hold multiple size umbrellas and can be used on different ground surfaces like sand, mud, grass and dirt. The present invention is mostly round and made of steel, with spikes so that the user can use the device on a slope and still have the shade without the umbrella falling over. The present invention is preferably a frame and does not collapse.

US Patent 2005/0189005 A1 discloses an umbrella base. The present invention solves the problem of '005 by giving the user the ability to use the umbrella stand on uneven ground or surfaces without having to worry about falling over due to heavy winds. The present invention is different than '005 because it can be used in dirt, sand, grass and mud without compromising the function of shade. The present invention is different than US Patent '005 because the present invention does have wheels, can function on uneven ground and hold multiple size umbrella. The present invention is lightweight, round with steel spikes and can be moved from one location to another location with very little effort. The present invention is not intended to be used on concrete, wood decks or any other hard surfaces.

U.S. Pat. No. 7,207,450 ("'450") discloses a beverage holder device. The present invention solves the problem of '450 by being an umbrella holder that holds multiple size umbrellas with little issues of it falling over. The present invention is also different than '450 because a function of the present invention is to hold umbrellas on multiple ground surfaces and function for shade. The present invention provides shade for the user by being a solid frame which holds various size umbrellas and will not fall over due to weather.

U.S. Pat. No. 5,354,031 ("'031") discloses a low profile umbrella base. The present invention solves the problem of '031 by being able to function on uneven ground and does not require the use of sand to steady the base. The present invention is different than '031 because it can be create shade on various ground conditions from sand, dirt, mud and grass. The present invention is round with six different spikes and can hold multiple size umbrellas. The present invention is also light weight, moves with ease, can withstand weather and wind without having any issues of falling over. The present invention is intended not to be used on wood, concert, or other hard surfaces.

US Patent 2006/0054206 ("'206") is for an umbrella base with wheels. The present invention solves the problem of '206 by being able to fiction and create shade on uneven ground or on a slope. The present invention is also different than '206 because it is not intended to be used on a patio or other hard surfaces. The present invention is designed to create shade for the user on uneven soft surfaces like sand, dirt, mud and grass, and then be moved with very little trouble. The present invention is made of steel, has six spikes and requires little effort to move and set up. It can and will handle heavy winds and weather. The present invention does not have wheels; however will work on hills, slopes, and angles. The present invention is intended to be used over and over and moved from one location to another as the sun rises and falls.

US Patents 2008/0017226 ("'226") and U.S. Pat. No. 7,380,561 ("'561"), are for portable, displaceable anchor stands. The present invention solves the problems of '226 and '561 by being made of steel, having 6 spikes, not 4, and is round in diameter. The present invention is also different than US Patents '226 and '561 because the present invention not only functions well in sand, it will work just as well in grass, dirt and mud, and still have the stability to withstand wind and weather. The present invention is round and made of steel and has six steel spikes, the present invention will therefore be stronger and moored more durably. If you come across hard grass, or dirt, the present invention can be pushed into the surface with force because of the steel spikes.

SUMMARY

In several embodiments, the present invention is a portable ground anchoring tubular holding unit comprising a circular ring shaped base; said circular ring shaped base further comprising an upper, middle, and lower section; a central hollow column mechanically attached to said circular ring shaped base via a plurality of spokes extruding from said central hollow column to said circular ring shaped base; a plurality of ground spikes, wherein said ground spikes are attached and are in mechanical communication with said lower section of said circular ring shaped base.

In several embodiments the invention further comprises a support collar in mechanical communication with said central hollow column and said spokes. In several embodiments the invention further comprises said circular ring shaped base; said central hollow column, said plurality of spokes, and said plurality of ground spikes are all comprised of metal. In several embodiments the invention further comprises cup holders with anchor spikes wherein said plurality of spokes extruding from said central hollow column to said circular ring shaped base have orifices to engage said cup holders with anchor spikes. In several embodiments the invention further comprises said cup holders with anchor spikes are comprised of metal.

In several embodiments the invention further comprises said plurality of spokes extruding from said central hollow column to said circular ring shaped base number at least four spokes. In several embodiments the invention further comprises that said central hollow column can maintain an inserted pole perpendicular to said circular ring shaped base. In several embodiments the invention further comprises said ground spikes can be inserted into one or more of the following ground conditions: sand, grass, solid earth, semisolid mud, nonplanar and/or planar surfaces. In several embodiments the invention further comprises said central hollow column can maintain an inserted umbrella shaft perpendicular to said circular ring shaped base.

In several embodiments the present invention comprises a method for using a portable ground anchoring tubular holding unit comprising the steps of obtaining a portable ground anchoring tubular holding unit which comprises a circular ring shaped base; said circular ring shaped base further comprising an upper, middle, and lower section; a central hollow column mechanically attached to said circular ring shaped base via a plurality of spokes extruding from said central hollow column to said circular ring shaped base; a plurality of ground spikes wherein said ground spikes are attached and in mechanical communication with said lower section of said circular ring shaped base inserting said portable ground anchoring tubular holding unit into a surface by pushing said ground spikes into said surface until said circular ring shaped base is rigidly held in relation to said surface.

In several embodiments the method further comprises obtaining cup holders with anchor spikes; wherein said plurality of spokes extruding from said central hollow column to said circular ring shaped base have orifices to engage said cup holders with anchor spikes; inserting said anchor spikes into said plurality of spokes extruding from said central hollow column to said circular ring shaped base have orifices to engage said cup holders with anchor spikes.

In several embodiments the method further comprises the additional step of inserting a pole perpendicular to said circular ring shaped base into said central hollow column. In several embodiments the method further comprises the additional step of inserting said ground spikes into one or more of the following ground conditions: sand, grass, solid earth, semisolid mud, nonplanar and/or planar surfaces.

BRIEF DESCRIPTION OF THE DRAWINGS

For a more complete understanding of the present disclosure and the advantages thereof, reference is now made to the following descriptions to be taken in conjunction with the accompanying drawings describing specific embodiments of the disclosure, wherein.

DETAILED DESCRIPTION

Figure 1:
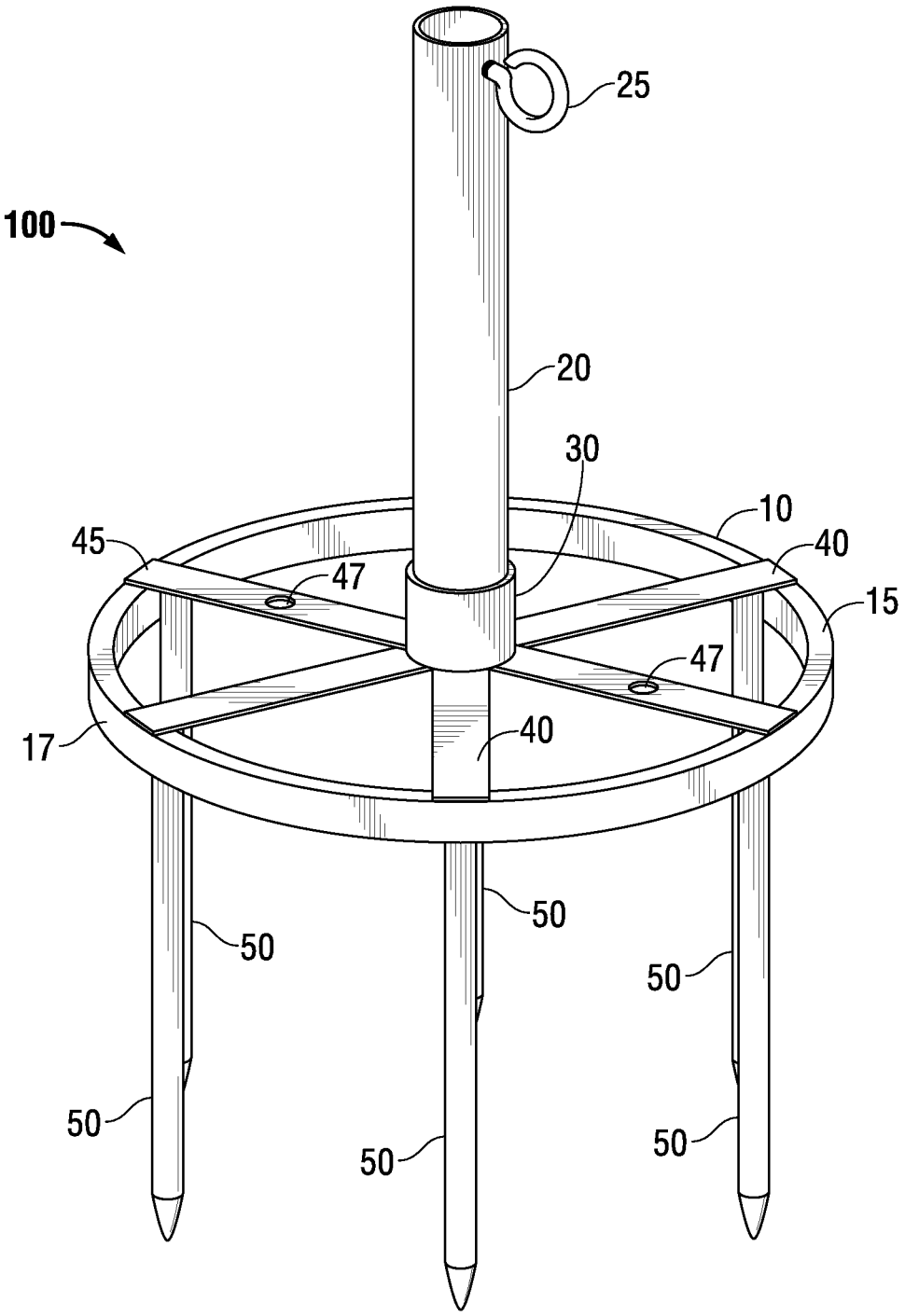
FIG. 1 an assembled view of one embodiment of the present invention.

One or more illustrative embodiments incorporating the invention disclosed herein are presented below. Applicant has created a revolutionary tubular holding device for ground insertion.

In the following description, certain details are set forth such as specific quantities, sizes, etc. so as to provide a thorough understanding of the present embodiments disclosed herein. However, it will be evident to those of ordinary skill in the art that the present disclosure may be practiced without such specific details. In many cases, details concerning such considerations and the like have been omitted inasmuch as such details are not necessary to obtain a complete understanding of the present disclosure and are within the skills of persons of ordinary skill in the relevant art.

Referring to the drawings in general, it will be understood that the illustrations are for the purpose of describing particular embodiments of the disclosure and are not intended to be limiting thereto. Drawings are not necessarily to scale and arrangements of specific units in the drawings can vary.

While most of the terms used herein will be recognizable to those of ordinary skill in the art, it should be understood, however, that when not explicitly defined, terms should be interpreted as adopting a meaning presently accepted by those of ordinary skill in the art. In cases where the construction of a term would render it meaningless or essentially meaningless, the definition should be taken from Webster's Dictionary, 11th Edition, 2008. Definitions and/or interpretations should not be incorporated from other patent applications, patents, or publications, related or not, unless specifically stated in this specification or if the incorporation is necessary for maintaining validity. Specifically defined terms: "Hollow Column" as defined herein is designed to hold many objects including tubulars of smaller diameter as well as umbrella shafts and other tubular or approximately tubular items.

Certain terms are used in the following description and claims to refer to particular system components. As one skilled in the art will appreciate, different persons may refer to a component by different names. This document does not intend to distinguish between components that differ in name but not function. The drawing figures are not necessarily to scale. Certain features of the invention may be shown exaggerated in scale or in somewhat schematic form, and some details of conventional elements may not be shown, all in the interest of clarity and conciseness.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

FIG. 1 illustrates one embodiment of the present invention in assembled form. In many embodiments the present invention 100 has a hollow column 20, a substantially circular base 10, spokes 40 and 45, as well as ground spikes 50. In several embodiments of the present invention, hollow column 20 is mechanically attached to circular base 10 via spokes 45 and 40. In several embodiments of the present invention, ground spikes 50 attach to spokes 40 and 45. In several embodiments of the present invention 100, the present invention can be comprised of individually welded parts or of a singular cast molding.

Figure 9:
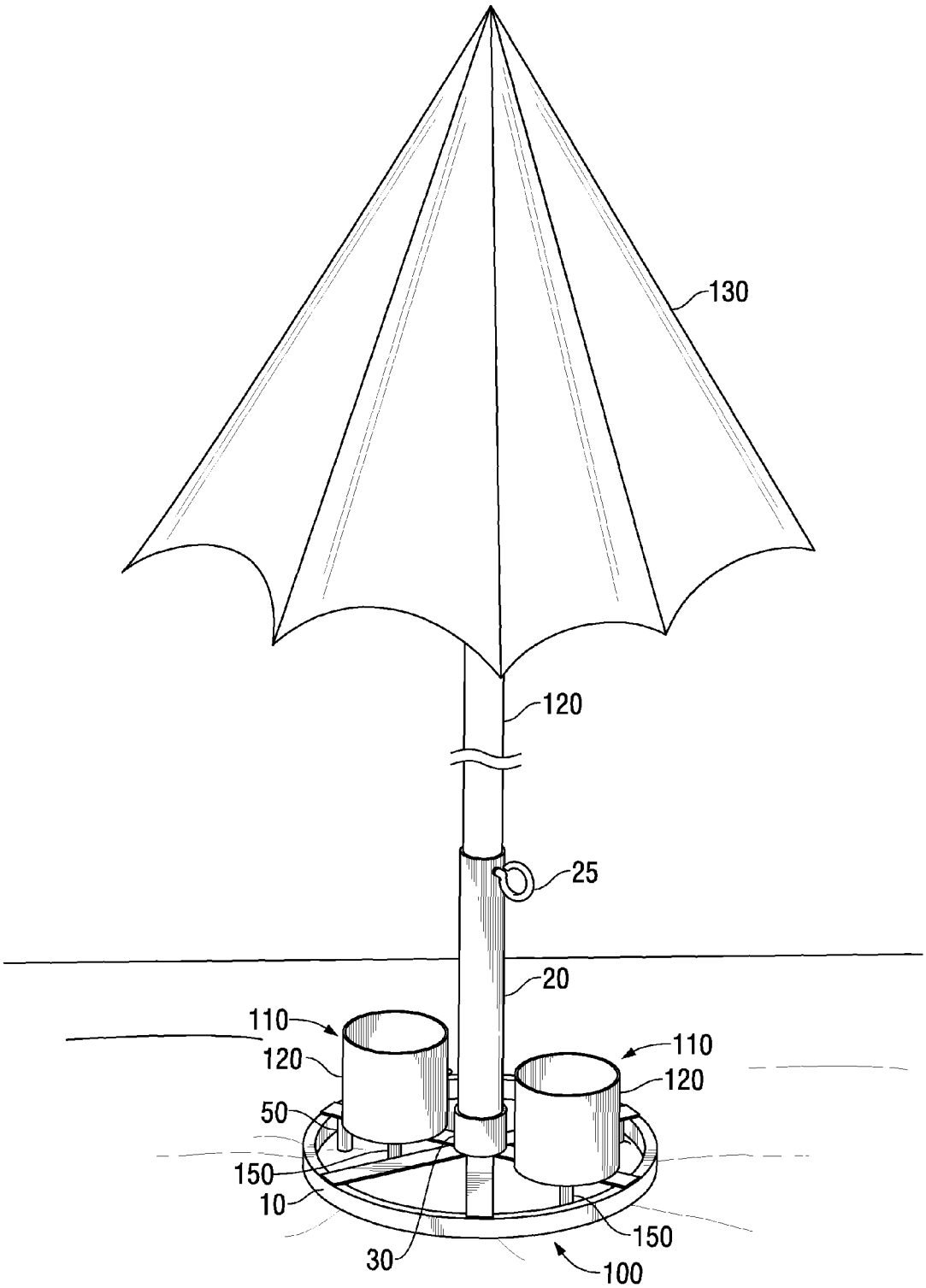
FIG. 9 is an assembled view of one embodiment of the present invention with an umbrella, as utilized and inserted into the ground.

In several embodiments of the present invention, hollow column 20 is preferably constructed to allow for the housing of tubulars in the inner hollow section. The tubulars to be housed can be solid or hollow themselves, by way of example, in preferred embodiments the hollow column 20 can house the shaft of an umbrella (See FIG. 9). Optionally, and illustrated, is hook screw 25 which can be used to tighten tubulars and hold them securely within column 20 when in operation (FIG. 9). In several embodiments column 20 is constructed of sturdy materials such as metal, high strength plastic, or the like. In several embodiments of the present invention column 20 maybe mechanically secured to spokes 40 and 45 by collar 30 in a manner as is known in the art for mechanical attachment. In several embodiments, hollow column 20 can attach to spokes 40 and 45 directly, or through a cast molding.

In several embodiments of the invention, spokes 40 and 45 traverse the center of ring base 10. As illustrated, spokes 45 are solid and traverse the diameter of ring base 10. As shown spoke 45 has two orifices 47 traversing from the top to the bottom of spoke 45. As illustrated there are two spokes 40 and one spoke 45 traversing the rings base 10 and substantially joining in the middle at the same proximate location as the base of hollow column 20. It is envisioned that spokes 45 and 40 can be constructed of one solid piece each, or of two pieces joined at the junction with the base of hollow column 20. In several embodiments spokes 45 and 40 constructed of sturdy materials such as metal, high strength plastic, or the like. In several embodiments of the present invention, spokes 45 and 40 can be welded to ring base 10 or cast a solid piece with ring base 10.

Ring base 10 is constructed to be substantially a circle in shape, but can be cast in variant shapes as well. In several embodiments, ring base 10 is constructed of sturdy materials such as metal, high strength plastic, or the like. In several embodiments, spokes 45 and 40 attach to the top 15 of ring base 10 in a manner as is known in the art. In variant embodiments spokes 45 and 40 can attach to the interior of ring base 10 or the bottom of ring base 10. Ring base 10 may be constructed as a ring tube, a flat surfaced ring with top 15, outer side 17 and bottom 19, or any three dimensional ring with solid faces as known in the art.

In several embodiments of the present invention ground spikes 50 attach to the undersides of spokes 40 and 45 near the juncture with spokes 45 and 40 and ring base 10. In several embodiments ground spikes 50 are constructed of sturdy materials such as metal, high strength plastic, or the like. In several embodiments the number of ground spikes 50 is the same as spoke attachments to ring base 10. In several embodiments of the present invention ground spikes 50 are mechanically attached to both ring base 10 and spokes 45 and 40 in a manner as is known in the art. In several embodiments of the present invention ground spikes 50 are mechanically attached to just ring base 10 in a manner as is known in the art.

In several embodiments spokes 45 can be constructed with orifices 47 traversing the top to bottom of spokes 45. The number of spokes 45 attached to ring base 10 can vary and the number and locations of orifices 47 can vary as well. In several embodiments of the present invention, and as illustrated, there is one orifice on each side of hollow column 20 as attached to spoke 45.

Figure 2:
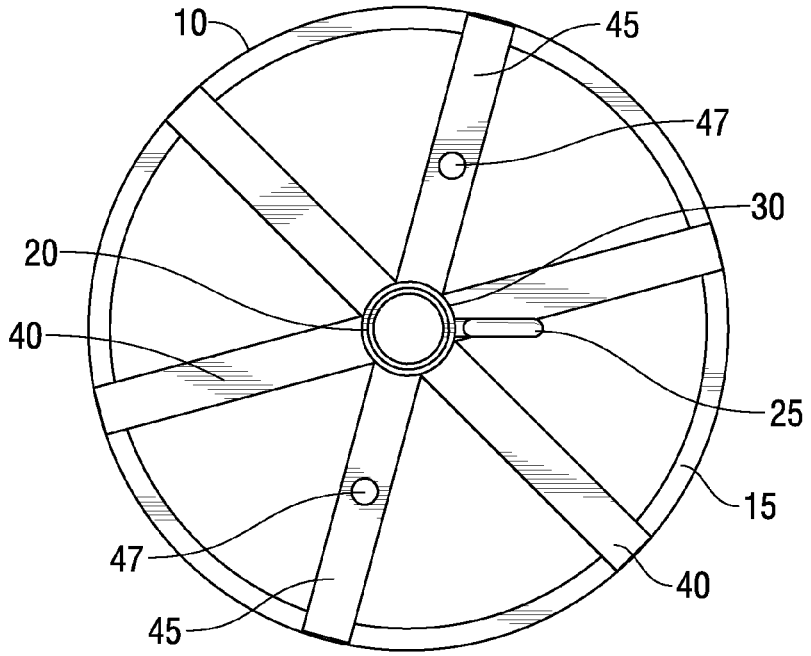
FIG. 2 is a top view of one embodiment of the present invention.

FIG. 2 illustrates a top view of one embodiment of the present invention. Illustrated is the hollow column 20 located substantially in the center of ring base 10. Also illustrated are orifices 47 on spoke 45. Spokes 45 and 40 are attached to the top 15 of ring base 10. In several embodiments spoke 45 and 40 can be attached to any portion of the ring base 10.

Figure 3:
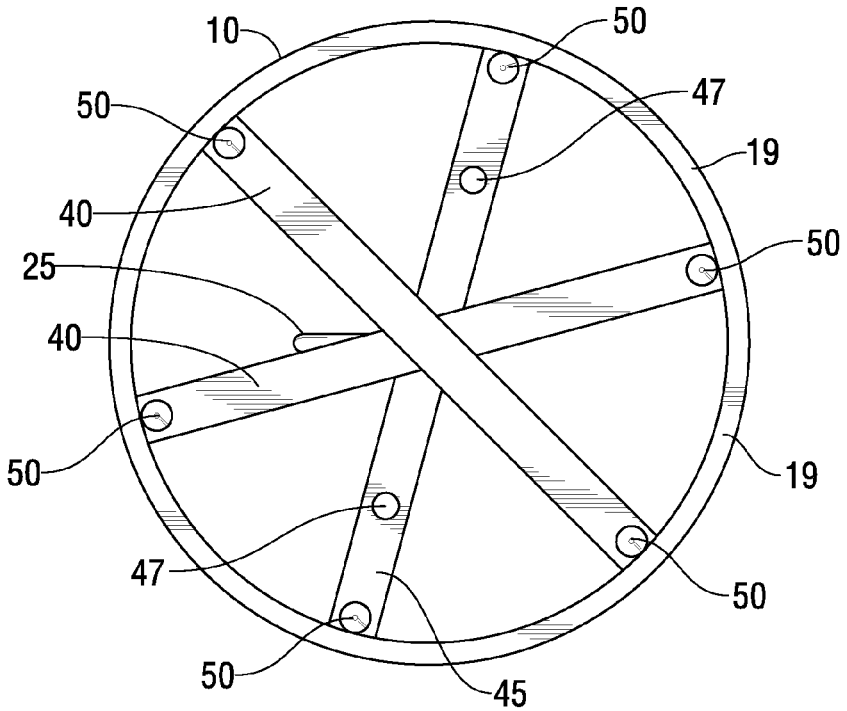
FIG. 3 is a bottom view of one embodiment of the present invention.

FIG. 3 is a bottom view of one embodiment of the present invention. Illustrated are ground spikes 50 which are attached to spokes 45 and 40 near, or in connection to, ring base 10. In several embodiments of the present invention spokes 40 and 45 can overlap at substantially the center of ring base 10. The order of overlap, and the number of spokes 40 and 45 can vary. Also illustrated are orifices 47 on spoke 45.

Figure 4:
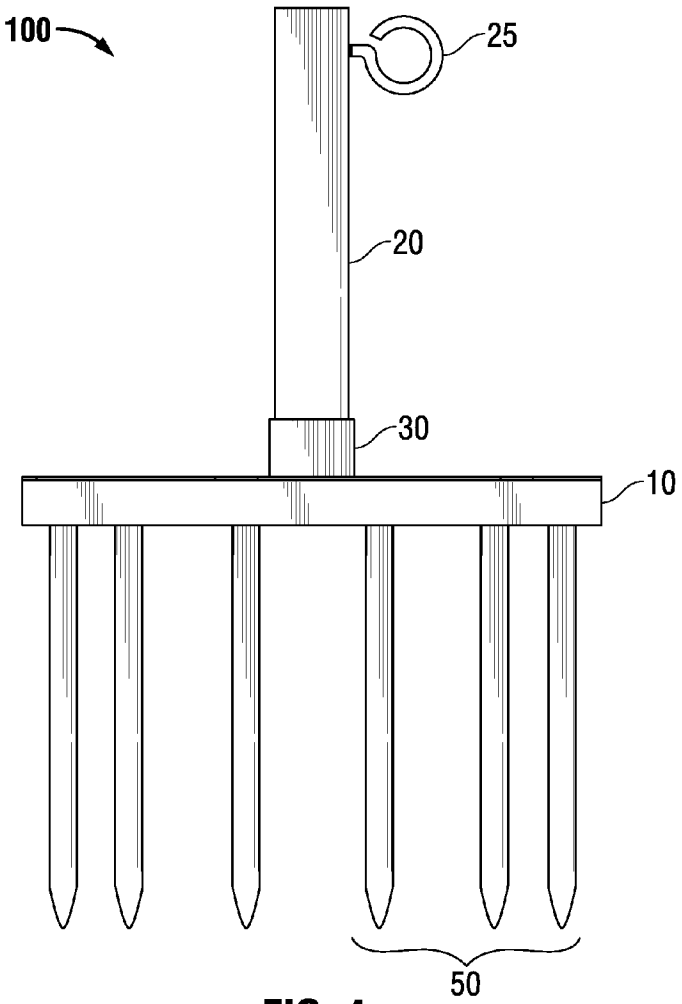
FIG. 4 is a front assembled view of one embodiment of the present invention.

FIG. 4 is a front assembled view of one embodiment of the present invention. Illustrated are ground spikes 50, ground ring 10, collar 30 and column 20. Also shown is hook screw 25. Hook screw 25 can be constructed of any materials as is known in the art.

Figure 5:
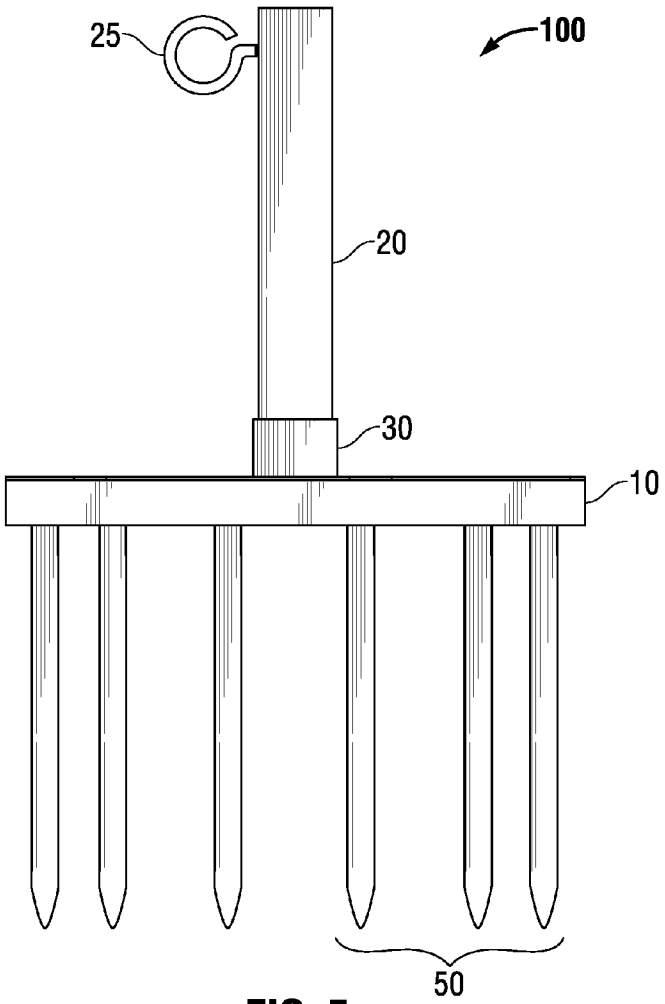
FIG. 5 is a back assembled view of one embodiment of the present invention.

FIG. 5 is a back assembled view of one embodiment of the present invention. Illustrated are ground spikes 50, ground ring 10, collar 30 and column 20. Also shown is hook screw 25. In several embodiments of the present invention it is preferred that there are six ground spikes, although it is envisioned that there could be any number of ground spikes.

Figure 6:
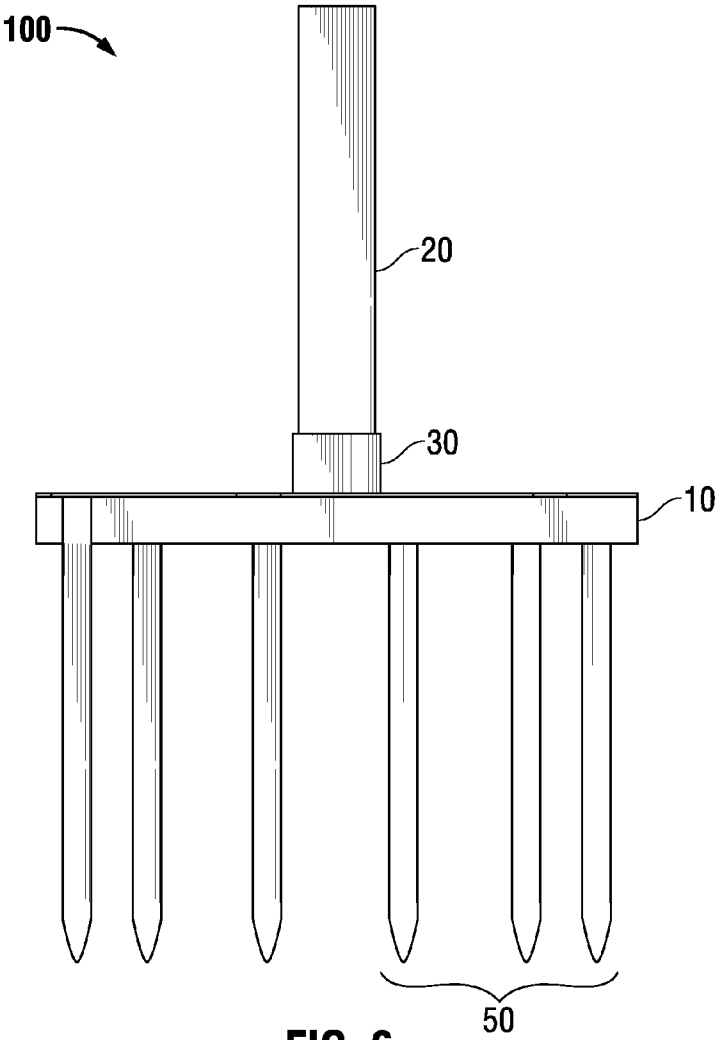
FIG. 6 is a left assembled view of one embodiment of the present invention.

FIG. 6 is a left assembled view of one embodiment of the present invention. Illustrated are ground spikes 50, ground ring 10, collar 30 and column 20. Also shown is hook screw 25.

Figure 7:
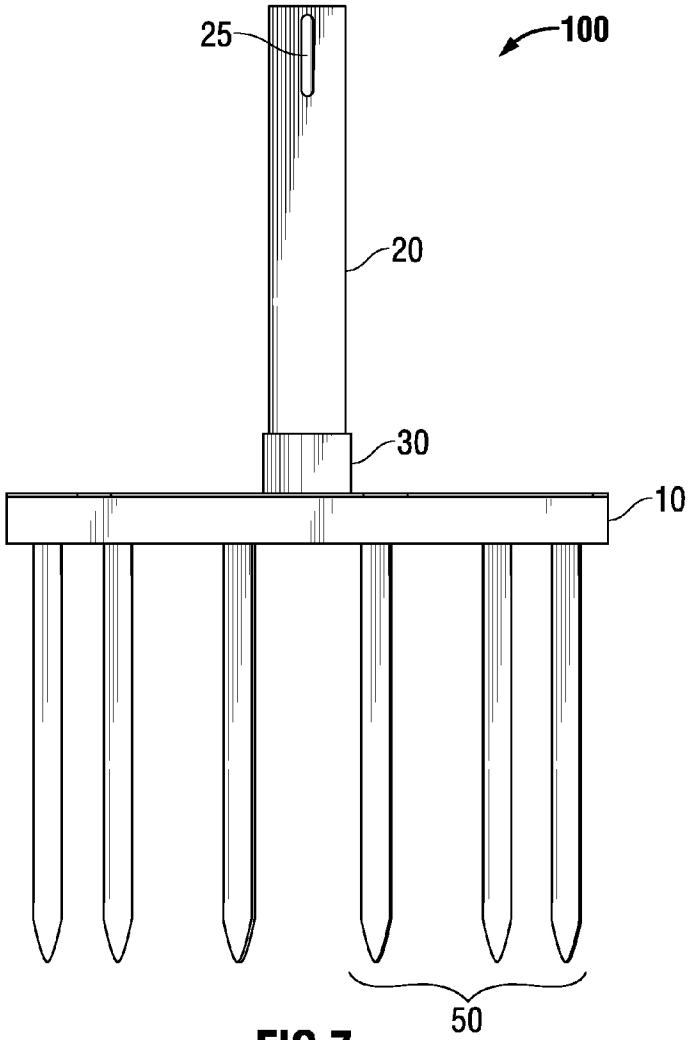
FIG. 7 is a right assembled view of one embodiment of the present invention.

FIG. 7 is a right assembled view of one embodiment of the present invention. Illustrated are ground spikes 50, ground ring 10, collar 30 and column 20. Also shown is hook screw 25. In several embodiments of the present invention it is preferred that there are six ground spikes.

Figure 8:
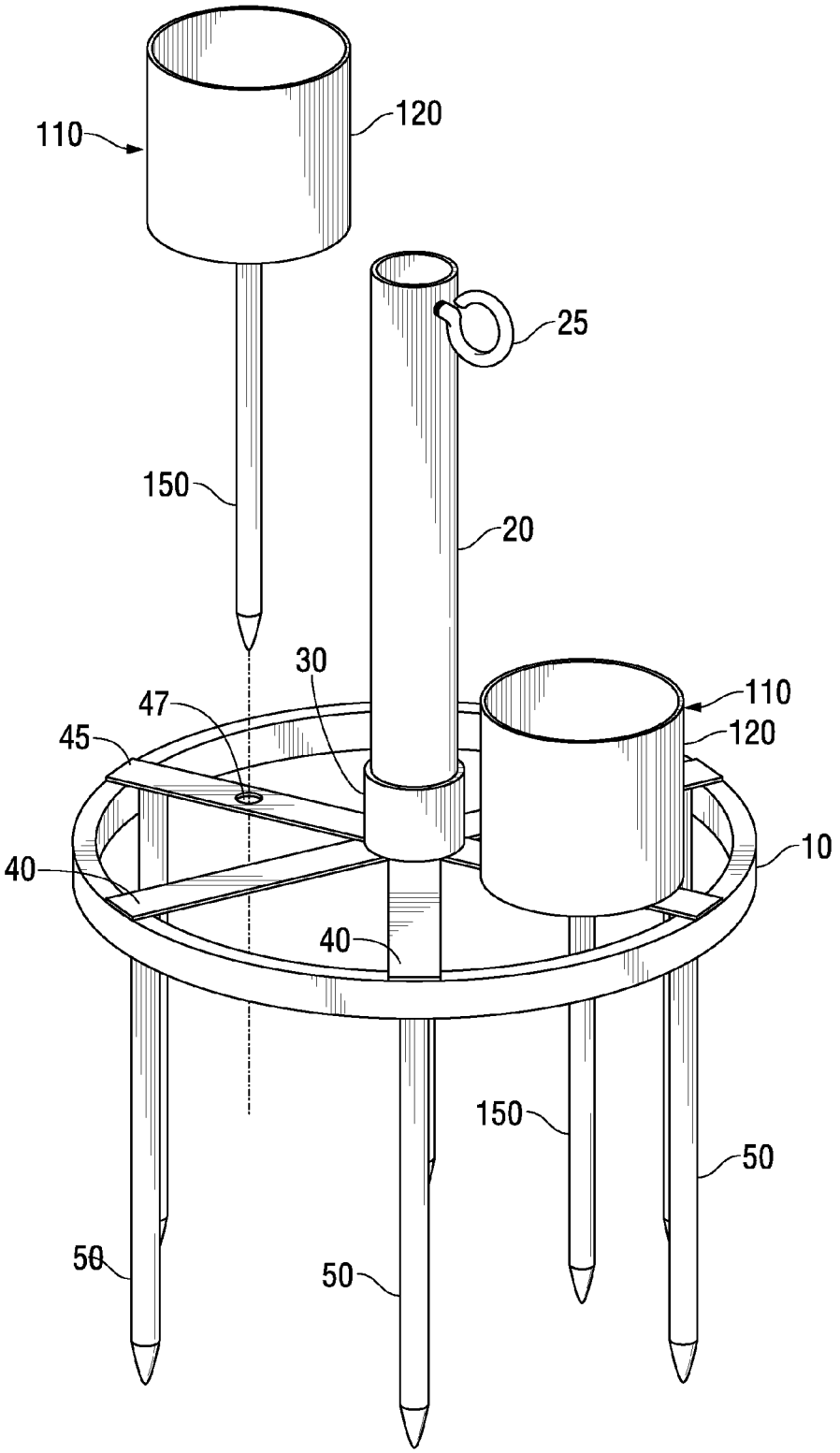
FIG. 8 is a partially assembled view of one embodiment of the present invention with ground cups both inserted and not inserted.

FIG. 8 is a partially assembled view of one embodiment of the present invention with ground cups. As shown, ground cups 110 are preferably constructed with a hollowed column 120 and cup spikes 150. Hollowed column 120 is preferably designed to be able to house other items such as another cup, bottles, glasses or other solid items that can be held by a cup and as are known in the art. Attached to the solid bottom of hollowed column 120, in a manner known art, is cup spike 150. Cup spike 150 is preferably designed to have a radius that is small enough to enable it to be placed through orifice 47 when one embodiment of the present invention is assembled for use. FIG. 8 shows one ground cup 110 which is not engaged through orifice 47 and one which is engaged.

FIG. 9 is an assembled view of one embodiment of the present invention with an umbrella as utilized and inserted into the ground. As shown, in operation, the present inventive device is inserted into the ground such that ground spikes 50 enter into the ground and releasably, but securely, hold ring base 10 either on the ground directly or substantially close to the ground. Ground cups 110 are then inserted in orifices 47 and then cup spikes 150 are also pressed into the ground.

A user can then put an umbrella shaft 120 (or essentially any other tubular) into column 20 and tighten said shaft 120 with hook screw 25. After insertion of shaft 120 into column 20 and tightening of hook screw 25, umbrella cap 130 can be opened in a manner as known in the art.

In preferred embodiments of the present invention the weight of the invention 100 along with the ground spikes 50 and circular nature of ring base 10 improved stability is offered over prior art umbrella holders through disbursement of forces, such as wind evenly about base 10 and into the ground itself.

While preferred embodiments have been shown and described, modifications thereof can be made by one skilled in the art without departing from the scope or teaching herein. The embodiments described herein are exemplary only and are not limiting. Many variations and modifications of the system and apparatus are possible and will become apparent to those skilled in the art once the above disclosure is fully appreciated. For example, the relative dimensions of various parts, the materials from which the various parts are made, and other parameters can be varied.

We claim:

1. A portable ground anchoring tubular holding unit comprising:

a single, central circular ring shaped base;

a central hollow column with no ground entering spike, which is attached to said single, central circular ring shaped base via a plurality of spokes extruding from said central hollow column with no ground entering spike to said single, central circular ring shaped base; and a plurality of ground entering spikes, wherein said ground entering spikes are attached and in mechanical communication with said single, central circular ring shaped base near the juncture of said plurality of spokes and said single central circular ring shaped base.

2. The portable ground anchoring tubular holding unit of claim 1, in which said column further comprises a support collar in mechanical communication with said central hollow column with no ground entering spike and said spokes.

3. The portable ground anchoring tubular holding unit of claim 1, in which said single, central circular ring shaped base, said central hollow column with no ground entering spike, said plurality of spokes, and said plurality of ground entering spikes are all comprised of metal.

4. The portable ground anchoring tubular holding unit of claim 1, further comprising:

a cup holder with an anchor spike, wherein at least one of said plurality of spokes extruding from said central hollow column with no ground entering spike to said single, central circular ring shaped base has an orifice to engage said cup holder with an anchor spike.

5. The portable ground anchoring tubular holding unit of claim 4 further comprising said cup holder with an anchor spike is comprised of metal.

6. The portable ground anchoring tubular holding unit of claim 1, wherein said plurality of spokes extruding from said central hollow column with no ground entering spike to said single, central circular ring shaped base number at least four spokes.

7. The portable ground anchoring tubular holding unit of claim 1, in which said central hollow column with no ground entering spike can maintain an inserted pole perpendicular to said single, central circular ring shaped base.

8. The portable ground anchoring tubular holding unit of claim 1, in which said ground entering spikes can be inserted into one or more of the following ground conditions: sand, grass, solid earth, semisolid mud, nonplanar and/or planar surfaces.

9. The portable ground anchoring tubular holding unit of claim 1, in which said central hollow column with no ground entering spike, said spokes, said single, central circular ring base and said ground entering spikes are cast of a single piece of material.

10. A method for using a portable ground anchoring tubular holding unit comprising the steps of:

obtaining a portable ground anchoring tubular holding unit comprising:

a single, central circular ring shaped base with a lower section;

a central hollow column with no ground entering spike, which is mechanically attached to said circular ring shaped base via a plurality of spokes extruding from said central hollow column with no ground entering spike to said single, central circular ring shaped base;

a plurality of ground entering spikes, wherein said ground entering spikes are attached with said lower section of said single, central circular ring shaped base near the juncture of said plurality spokes and said single central circular ring shaped base;

inserting said portable ground anchoring tubular holding unit into a ground surface by pushing said ground entering spikes into said surface until said single, central circular ring shaped base is rigidly held in relation to said surface.

11. The method for using a portable ground anchoring tubular holding unit of claim 10 with the additional steps of:

obtaining cup holders with anchor spikes wherein said plurality of spokes extruding from said central hollow column with no ground entering spike to said single, central circular ring shaped base having orifices to engage said cup holders with anchor spikes;

inserting said anchor spikes into said plurality of spokes extruding from said central hollow column with no ground entering spike to said single, central circular ring shaped base having orifices to engage said cup holders with anchor spikes.

12. The method for using a portable ground anchoring tubular holding unit of claim 10 with the additional step of:

inserting a pole perpendicular to said single, central circular ring shaped base into said central hollow column with no ground entering spike.

13. The method for using a portable ground anchoring tubular holding unit of claim 10 with the additional step of:

inserting said ground entering spikes into said ground with one or more of the following ground conditions: sand, grass, solid earth, semisolid mud, nonplanar and/or planar surfaces.

14. A portable ground anchoring tubular holding unit comprising:

a single, central circular ring shaped base;

a central hollow column with no ground entering spike, which is attached to said single, central circular ring shaped base via a plurality of spokes extruding from said central hollow column with no ground entering spike to said single, central circular ring shaped base;

a plurality of ground entering spikes, wherein said ground entering spikes are attached and in mechanical communication with said single, central circular ring shaped base and said plurality of spokes near the juncture of said plurality of spokes and said single central circular ring shaped base.

* * * * *